US005599048A

United States Patent [19]

Schioler

[11] Patent Number: 5,599,048

[45] Date of Patent: Feb. 4, 1997

[54] PHOSPHORESCENT BOOK

[76] Inventor: Thomas Schioler, 194 Douglas Park Road, Winnipeg, Manitoba, Canada, R3J 1Z2

[21] Appl. No.: 399,719

[22] Filed: Mar. 6, 1995

[30] Foreign Application Priority Data

Mar. 4, 1994 [CA] Canada ..... 2116993

[51] Int. Cl.[6] ..... B42D 1/00

[52] U.S. Cl. ..... 283/92; 281/22; 281/38; 281/51; 283/63.1; 283/61; 283/62

[58] Field of Search ..... 40/160, 542; 283/92, 283/61, 62, 63.1; 281/22, 21.1, 27.1, 27.2, 35, 38, 51; 428/690, 53, 44, 45

[56] References Cited

U.S. PATENT DOCUMENTS

| | | | |
|---|---|---|---|
| 2,340,227 | 1/1944 | Russell | 40/542 |
| 2,347,285 | 4/1944 | Russell | 40/542 |
| 2,501,902 | 3/1950 | Howell | 283/63.1 X |
| 2,629,956 | 3/1953 | Switzer | 428/29 |
| 3,738,686 | 6/1973 | Morse | 283/63.1 |
| 4,745,286 | 5/1988 | Jones | 40/542 X |
| 5,118,138 | 6/1992 | Brotz | 402/80 R X |
| 5,149,568 | 9/1992 | Beck | 428/690 X |
| 5,172,937 | 12/1992 | Sachetti | 283/92 X |
| 5,270,100 | 12/1993 | Giglio | 40/542 X |
| 5,301,982 | 4/1994 | Brotz | 283/83 |
| 5,460,414 | 10/1995 | Sargis | 281/38 |

*Primary Examiner*—Frances Han

*Attorney, Agent, or Firm*—Adrian D. Battison; Murray E. Thrift

[57] ABSTRACT

A book is formed from a number of rigid pages each formed from a stiff material. All of the indicia on the pages are formed from a material having luminescent properties and also having a thickness on the page to form a relief pattern on the page. The luminescent also includes colored pigment providing different colors on the page. The indicium elements on each page are arranged relative to the next adjacent page so that they do not overlap when the pages are closed. An edge bead is applied onto relatively thick page edges to illuminate the edges and to provide a soft feel to the edges.

8 Claims, 3 Drawing Sheets

PHOSPHORESCENT BOOK

BACKGROUND OF THE

This invention relates to a luminescent book of a type for educating and entertaining children.

Very many different designs of books are available for educating children in view of the importance of encouraging children to enjoy books.

It is one object of the present invention to provide an improved book of a type which includes phosphorescent material for providing an enhanced level of enjoyment.

SUMMARY OF THE INVENTION

According to the invention, therefore, there is provided a book comprising a plurality of pages each formed from a substantially rigid sheet material, means coupling the pages at one edge of the pages for opening and closing movement of the pages each relative to the next, an indicia marked on each page comprising a raised relief pattern formed from a phosphorescent material.

The term "luminescent" as used herein and as defined in the Concise Science Dictionary published by Oxford University Press relates to a substance which emits light for any reason other than a rise in its temperature. In general, atoms of substances emit protons of electro-magnetic energy when they return to the ground state after having been in an excited state. The term "phosphorescent" as used herein and as set out in the same definition relates to a substance in which the luminescence persists significantly after the exciting cause is removed.

The material therefore used in the present invention is phosphorescent in that, as set hereinafter, it is of a type in which the emission of light is maintained for a period of time after the absorption of light is complete.

Preferably substantially all of the indicia on each page of the book are formed from the phosphorescent material.

Preferably the phosphorescent material includes a plurality of different colors.

Preferably the indicia on at least some of the pages include at least one indicium element which is relatively large in comparison with the dimensions of the page and wherein the indicium element of each page is arranged at a different location on the page relative to the indicium element of a next adjacent facing page so that when the pages are closed, the indicium elements do not overlap.

Preferably the pages are connected by loops passing through overlying holes in the pages at the edge thereof.

One embodiment of the invention will now be described in conjunction with the accompanying drawings in which:

BRIEF DESCRIPTION OF THE DRAWINGS;

In the drawings like characters of reference indicate corresponding parts in the different figures.

DETAILED DESCRIPTION

The book comprises a plurality of pages 10, 11, 12 and 13 each of which are formed from a rigid board material so as to be self supporting, stiff and resistant to damage. The pages each have a pair of holes 14 and 15 arranged at or adjacent one edge 16 thereof so the pages can be inter-connected by a loop 17 of a suitable flexible material thus allowing the pages to be moved each one to the next in an opening and closing movement in the conventional action of a book.

Figure 3:
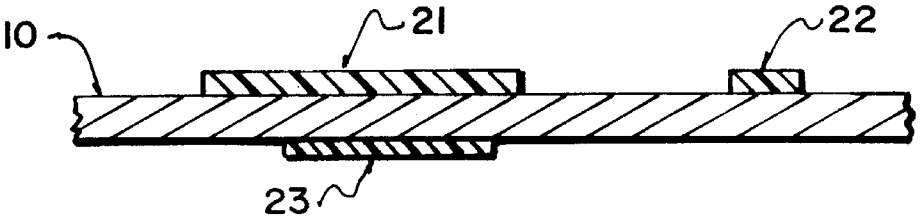
FIGS. 3 and 4 are cross-sectional views of two pages of the book showing the application of the phosphorescent material in raised relief pattern.

Each page of the book carries a plurality of indicia indicated at 18, 19 and 20 and shown only schematically so the details of the indicia are variable in accordance with the skills and desires of the author. The indicia are formed from raised portions 21 of a plastic material which has a phosphorescent material therein together with a coloring pigment therein. The raised indicia are shown in FIG. 3 and it will be seen that this material has a thickness to provide a relief pattern on the page. The stiffness of the page is sufficient to hold the plastic material rigid against flexing.

Different colors can be used in the pigment so that the indicium 21 is of a different color from the indicium 22 and from a yet further indicium 23 on an opposed side of the page 10.

The phosphorescent material is of a type which absorbs light and re-emits that light for a period of time. This is a known physical property and can be provided in phosphorescent material which can be added as a material into a support material. The support material is of a type which is supplied in liquid form but is readily set on exposure to air to form the relief pattern with the phosphorescent material contained therein. The material also contains sufficient pigment to provide a visual coloring. The thickness of the support material contains enough of the phosphorescent material to provide a relatively long lasting phosphorescent effect.

Figure 2:
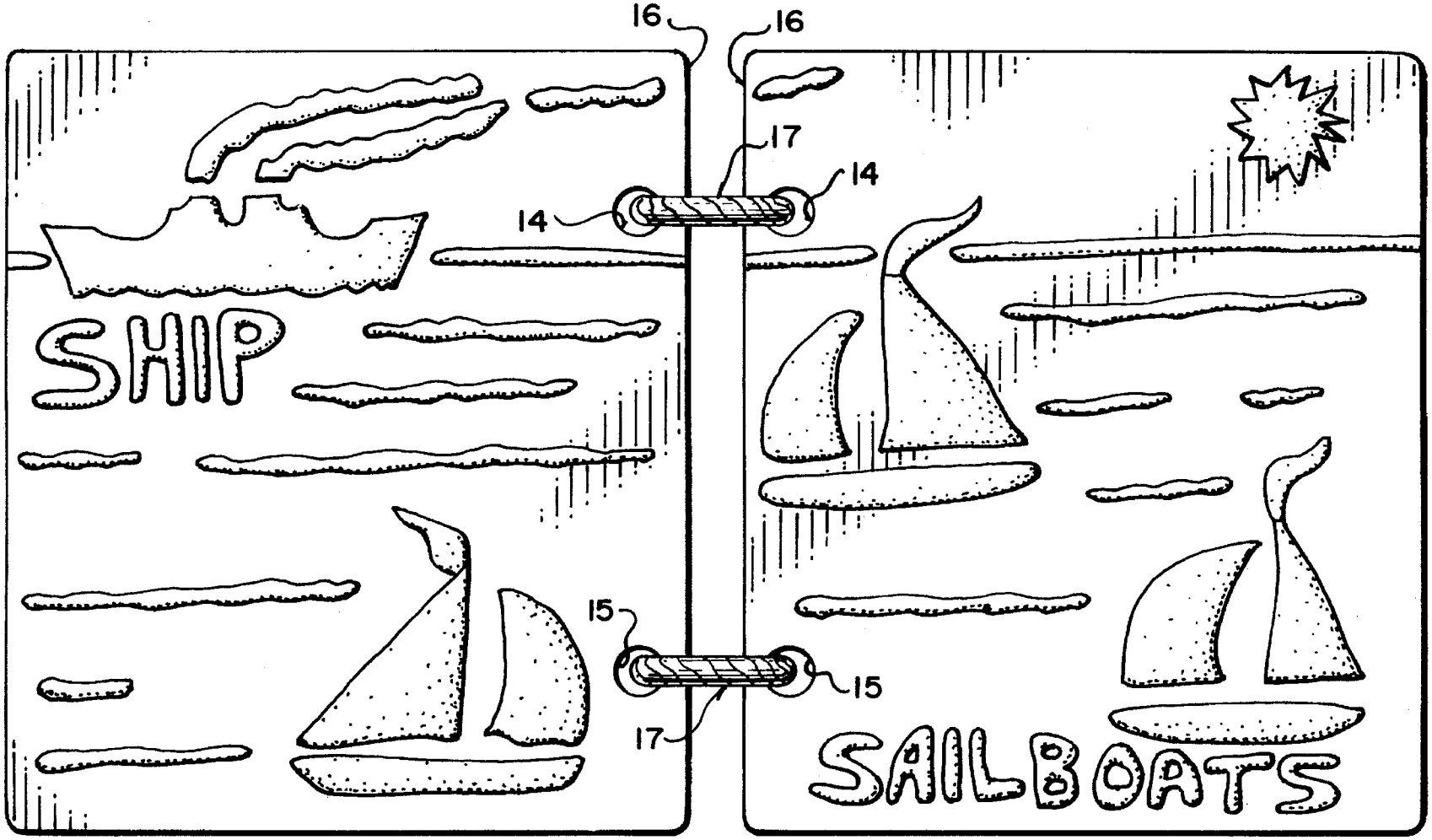
FIG. 2 is a plan view of two pages of the book in an opened condition.

In FIG. 2 is shown one example of two pages which are the next adjacent pages in the book. When the book is therefore closed, the two pages come into contact. It will be noted that each page contains one or more large indicium elements located on the page together with a number of smaller indicium elements. Each of the elements on the page is formed from the phosphorescent material. These elements can vary from the large indicium elements as shown to smaller lines or dots all formed of the same phosphorescent material.

Figure 1:
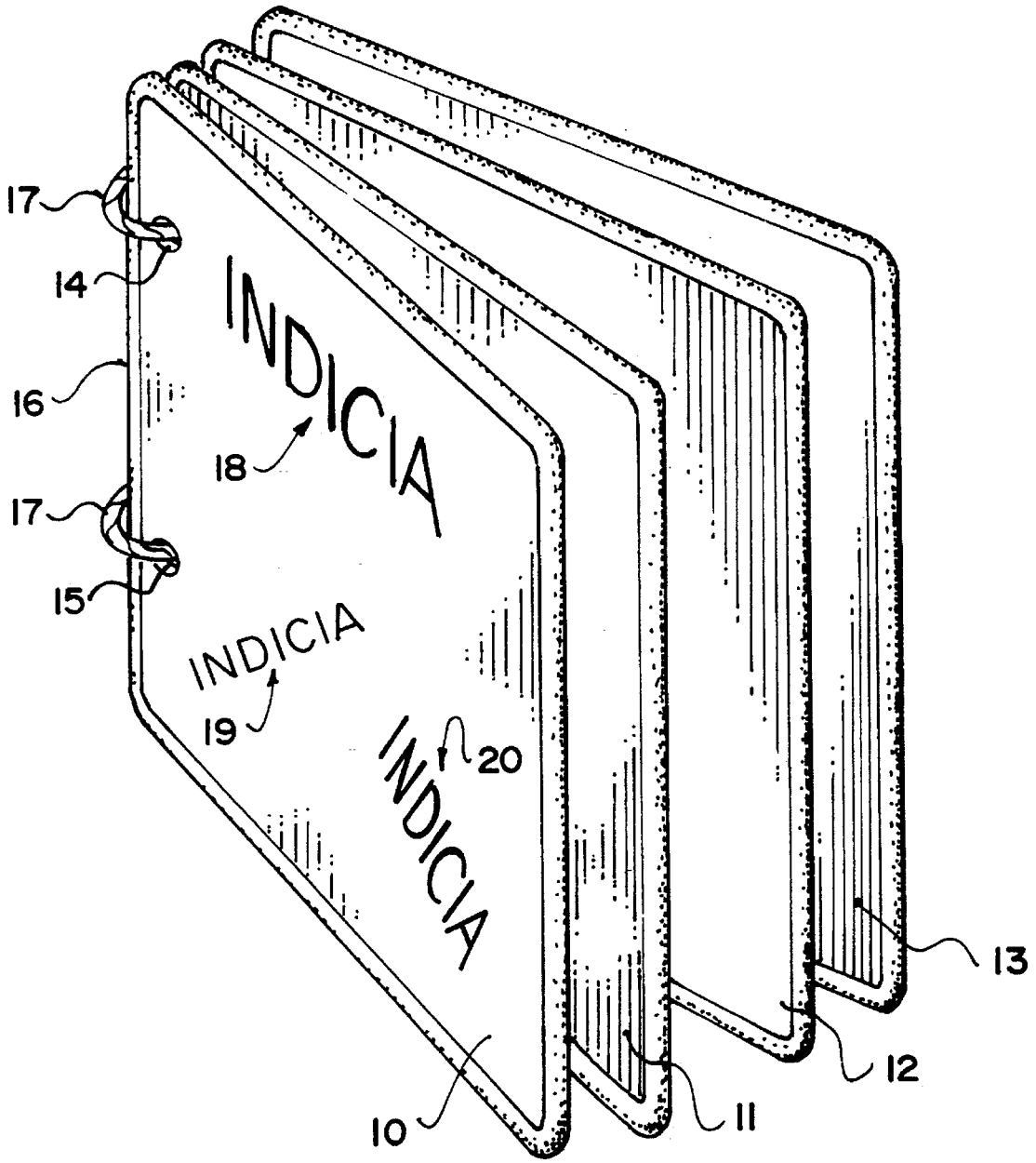
FIG. 1 is an isometric view of a book according to the present invention.

As will be noted from FIG. 2, the large indicium elements are located at different positions on the page so that when the pages are closed together, the large indicium elements of one page do not overlap with the large indicium elements of the second or next adjacent page. This prevents bonding of the large indicium elements when the book is closed so there is no tendency for any remaining adhesive effect of the material to cause permanent bonding of the pages closing the pages together, or causing damage of the indicium elements when the pages are opened. In addition a glaze such as a jewelry glaze manufactured by Delta which is clear, hard and non-toxic can be applied over the indicium elements and the whole page to protect the material and to further reduce the adhesive effect. The edges of the pages as shown in FIGS. 1 and 4 can also be coated with the same material with the phosphorescent effect to protect the edges and to provide an attractive appearance.

Figure 4:
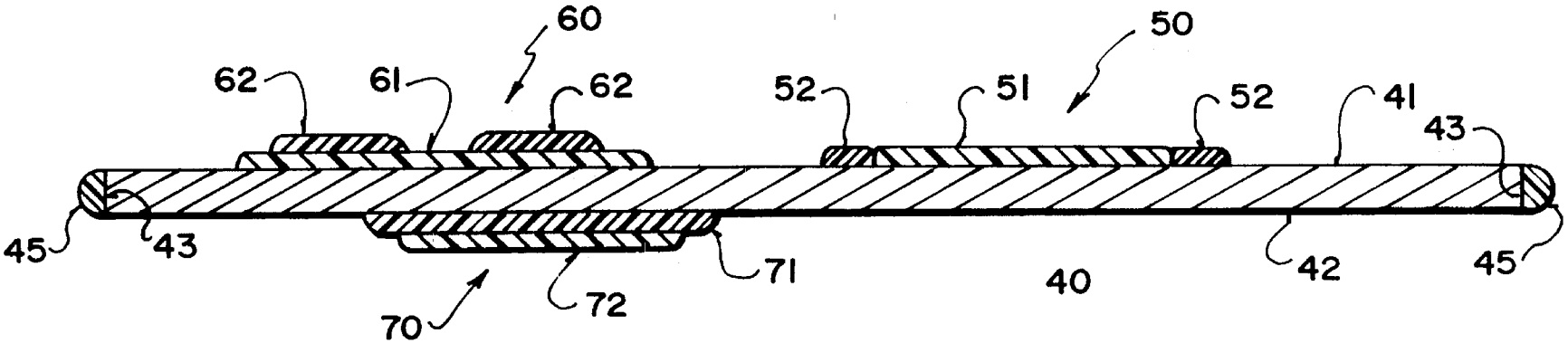

Turning now to FIG. 4, one of the pages that is indicated at 40 includes a front surface 41 and a rear surface 42 which define edges 43 of the page. The page is relatively thick for example of the order ⅛ inch so that it is rigid and is substantially inflexible in page size for example of the order of 6 inches by 6 inches or 3 inches by 3 inches.

The edges 43 around the full periphery of the page are covered by a bead 45 of the phosphorescent material. The bead can be applied as a narrow bead from a suitable dispensing gun or tube so that it engages only the edges and does not extend onto the front and rear surfaces of the page. It provides a cushioning for the edge and at the same time provides illumination for the edge when the phosphorescent is in effect. In view of the relief patterns provided by the application of the material onto the front and rear faces of the pages, the pages are held separate in the finished book so that the stack of pages in the finished book provides a stack of the beads in spaced position and thus providing illuminated lines at spaced positions when the book is viewed from one side. Alternatively the edge bead can be applied by a dipping process which causes the material also to slightly engage onto the faces of the pages while bridging the edge.

Also in FIG. 4 is illustrated a number of alternative arrangements for the relief patterns of the phosphorescent material in conjunction with a non-luminescent material. Preferably at least some of the non-luminescent material is of a character which includes visible sparkles within the material. The sparkles are not phosphorescent but provide an attractive appearance when the book is viewed in daylight.

Thus a first arrangement indicated at 50 of the phosphorescent material includes a layer 51 of the phosphorescent material which is bordered around its full periphery by a band or strip 52 of the non-luminescent material. This arrangement improves the attractive effect of the phosphorescent material since it provides a sharp edge to the phosphorescent material when viewed during its phosphorescent effect.

A second arrangement of the combination of phosphorescent and non-luminescent material is indicated at 60 in which the phosphorescent material 61 is applied as a layer to the surface of the page and the non-luminescent material 62 is applied on top of the layer to provide accents to the colouring of the phosphorescent material. This technique allows the application of different colours on top of the phosphorescent material to provide accents and shading which can enhance the visible effect of phosphorescent material when viewed under normal light.

A further arrangement of the combination of phosphorescent and non-luminescent material is indicated at 70 in which a layer of the non-luminescent material is indicated at 71 and is applied directly onto the surface of the page. On top of that layer 71 is provided a layer 72 of the phosphorescent material and this terminates at a position spaced inwardly from side edges of the initial layer so that a band of the initial layer of non-luminescent is visible around the edge of the phosphorescent material. This provides a possibility of improved visual effects during normal lighting and also provides a sharp edge for the phosphorescent material when viewed during the phosphorescent effect.

Various techniques can be used with the mixture of phosphorescent and non-luminescent materials generally of the type shown in FIG. 4. In one arrangement, a non-luminescent pattern is outlined around its periphery with the phosphorescent material. This provides a negative pattern which is discernible when viewing the page in the darkened condition since the outline of the glow provides a pattern of non-glow which is visible.

Another technique which can be used is to apply one of the materials over the other of the materials while leaving holes or slots in the second material through which the first material is visible. A yet further technique involves the application of multiple layers of the non-luminescent and phosphorescent materials which can be applied in circles each inside the next or similar patterns for example to provide the appearance of "eyes" in which the "white of the eye" is applied in the phosphorescent material and a dot of non-luminescent material is applied over the phosphorescent material to provide the "pupil".

A yet further technique involves the application of a translucent glitter material on top of the phosphorescent material. Different effects are obtained as to whether the non-luminescent glitter material is applied when the underlying phosphorescent layer is wet or if it is dried. When the layer remains wet, the translucent glitter material is to some extent absorbed into the phosphorescent layer and takes on the colour of the phosphorescent layer and also no longer retains its raised or relief pattern. This technique provides a particularly attractive effect in that the glitter is simply absorbed into the phosphorescent material to provide an attractive visual effect both in the dark and when viewed in normal light. A further subsidiary of this technique is to mix the phosphorescent and non-luminescent materials while wet so that patterns or swirls are formed of one with the other rather than forming a blend. This is effected by applying each of the materials to the page and by mixing the materials mechanically.

A yet further technique involves the application of a thinner pigmented material which does not provide the raised relief pattern so that it forms simply a colour wash without the relief effect. All of the other materials specified above to some extent provide a relief pattern relatively non-luminescent and phosphorescent conditions which provides a strong visual effect and also is highly tactile.

While one embodiment of the present invention has been described in the foregoing, it is to be understood that other embodiments are possible within the scope of the invention. The invention is to be considered limited solely by the scope of the appended claims.

I claim:

1. A book comprising a plurality of pages each formed from a substantially rigid sheet material, means coupling the pages at edges of the pages for opening and closing movement of the pages each relative to the next, and indicia carried on each page, at least some of the pages including indicia thereon which are formed of phosphorescent material of a plurality of different colors wherein the indicia are formed in a raised relief pattern.

2. A book comprising a plurality of pages each formed from a substantially rigid sheet material, means coupling the pages at edges of the pages for opening and closing movement of the pages each relative to the next, and indicia carried on each page, at least some of the pages including indicia thereon which are formed of phosphorescent material of a plurality of different colors, wherein the indicia are formed in a raised relief pattern and wherein at least one of the indicia includes a pattern formed of the phosphorescent material a part of which is covered by a non-luminescent material.

3. A book comprising a plurality of pages each formed from a substantially rigid sheet material, means coupling the pages at edges of the pages for opening and closing movement of the pages each relative to the next, and indicia carried on each page, at least some of the pages including indicia thereon which are formed of phosphorescent material of a plurality of different colors, wherein the indicia are formed in a raised relief pattern and wherein at least one of the indicia includes a pattern formed of the phosphorescent material which is surrounded around substantially a full periphery thereof by a band of a non-luminescent material.

4. The book according to claim 3 wherein the pattern formed of the phosphorescent material covers a layer of a non-luminescent material leaving the band of the non-luminescent material surrounding substantially a full periphery of the phosphorescent material defined by an outer portion of the layer.

5. A book comprising a plurality of pages each formed from a substantially rigid sheet material, means coupling the pages at edges of the pages for opening and closing movement of the pages each relative to the next, and indicia carried on each page, at least some of the pages including indicia thereon which are formed of phosphorescent material and wherein at least some of the pages have a thickness sufficient to define a discernible edge of the page different from front and rear surfaces of the page and wherein there is provided an edge bead of phosphorescent material lying on the edge of the page at least partly around a periphery of the page.

6. The book according to claim 5 wherein the edge bead is located substantially wholly on the edge of the page substantially without engaging the front and rear surfaces of the page.

7. The book according to claim 5 wherein the edge bead extends substantially wholly around a periphery of the page.

8. The book according to claim 5 wherein the indicia on the pages form a raised relief pattern such that two adjacent pages of the book when closed are spaced by the indicia so that the edge beads of the two adjacent pages are spaced.

* * * * *